US008777447B2

(12) United States Patent
Yamamoto

(10) Patent No.: US 8,777,447 B2
(45) Date of Patent: Jul. 15, 2014

(54) VARIABLE COLOR LIGHT EMITTING DEVICE AND ILLUMINATION APPARATUS USING THE SAME

(75) Inventor: Yuuya Yamamoto, Osaka (JP)

(73) Assignee: Panasonic Corporation, Osaka (JP)

( * ) Notice: Subject to any disclaimer, the term of this patent is extended or adjusted under 35 U.S.C. 154(b) by 280 days.

(21) Appl. No.: 13/478,603

(22) Filed: May 23, 2012

(65) Prior Publication Data

US 2012/0300450 A1 Nov. 29, 2012

(30) Foreign Application Priority Data

May 25, 2011 (JP) ..... 2011-116466

(51) Int. Cl.
*F21V 33/00* (2006.01)

(52) U.S. Cl.
CPC ..... *F21V 33/00* (2013.01)
USPC ..... 362/231

(58) Field of Classification Search
USPC ..... 362/231
See application file for complete search history.

(56) References Cited

U.S. PATENT DOCUMENTS

| | | | | |
|---|---|---|---|---|
| 2007/0291467 | A1 | 12/2007 | Nagai et al. | |
| 2009/0002604 | A1 | 1/2009 | Morimoto | |
| 2009/0296384 | A1 * | 12/2009 | Van De Ven et al. | 362/231 |
| 2011/0309773 | A1 * | 12/2011 | Beers et al. | 315/312 |

FOREIGN PATENT DOCUMENTS

| | | |
|---|---|---|
| JP | 2004-213986 | 7/2004 |
| JP | 2007-116117 | 5/2007 |
| JP | 2007-122950 | 5/2007 |
| JP | 2007-141737 | 6/2007 |
| JP | 2008-505433 | 2/2008 |
| JP | 2009-230907 | 10/2009 |

OTHER PUBLICATIONS

Extended European Search Report issued in corresponding European Application No. 12003917.7-1755, dated Feb. 13, 2014.

* cited by examiner

*Primary Examiner* — Laura Tso
(74) *Attorney, Agent, or Firm* — Bacon & Thomas, PLLC

(57) ABSTRACT

A variable color light emitting device includes first, second and third light sources differing in chromaticity of emission light; and a driver for changing light outputs. The chromaticities of the second and third light sources are selected such that, on straight lines passing through reference chromaticities of the second and third light sources and a chromaticity of an arbitrary color temperature on the blackbody locus, a ratio of a distance between the chromaticity of the second light source and the chromaticity on the blackbody locus to a distance between the chromaticity of the third light source and the chromaticity on the blackbody locus becomes equal to a ratio of a distance between the reference chromaticity of the second light source and the chromaticity on the blackbody locus to a distance between the reference chromaticity of third light source and the chromaticity on the blackbody locus.

7 Claims, 7 Drawing Sheets

VARIABLE COLOR LIGHT EMITTING DEVICE AND ILLUMINATION APPARATUS USING THE SAME

FIELD OF THE INVENTION

The present invention relates to a variable color light emitting device in which the chromaticity of mixed color light can be changed using a plurality of solid-state light emitting elements differing in chromaticity of the emitted light and an illumination apparatus using the same.

BACKGROUND OF THE INVENTION

A light emitting diode (hereinafter referred to as "LED") is capable of emitting high-illuminance light with a low level of electric power and is used as a light source for various kinds of electric devices such as a signal lamp and an illumination apparatus. In recent years, a blue LED as well as red and green LEDs is put into practical use. Light of many different colors can be generated by combining the red, green and blue LEDs. There is available a light emitting device using a plurality of LED light sources differing in emission color. The light emitting device complementarily controls the light intensity of the LED light sources and changes the chromaticity of mixed color light.

In this kind of light emitting device, if the deviation range of chromaticity of the LED light sources is wide, the deviation of chromaticity of the mixed color light grows larger. Thus the light colors of the light emitting devices manufactured differ from device to device. In general, the light having a chromaticity on the blackbody locus of chromaticity coordinates looks like white light in the sense of a human. On the other hand, if the chromaticity is deviated toward the deep ultraviolet side from the blackbody locus, the color difference is felt large and the light color looks unnatural.

There is known a variable chromaticity light emitting device capable of measuring the illuminance and chromaticity relative to an applied current with respect to individual light sources having different emission colors, feeding back the measurement results to correct the outputs of the respective light sources and consequently irradiating mixed color light with a desired chromaticity (see, e.g., Japanese Patent Application Publication No. 2004-213986 (JP2004-213986A)).

In the light emitting device disclosed in JP2004-213986A, however, a plurality of sensors and an expensive control unit having high operational performance are required in order to perform the feedback control by which a suitable mixing ratio is calculated and outputted using the measurement results of illuminance and chromaticity of the respective light sources. This may lead to an increased manufacturing cost.

SUMMARY OF THE INVENTION

In view of the above, the present invention provides a variable color light emitting device capable of reducing the chromaticity deviation of mixed color light and capable of being manufactured in a cost-effective manner and an illumination apparatus using the same.

In accordance with one aspect of the present invention, there is provided a variable color light emitting device, including: first, second and third light sources differing in chromaticity of emission light; and a driver for changing light outputs of the first, second and third light sources, wherein the first light source has a chromaticity closer to a blackbody locus in a chromaticity coordinates than chromaticities of the second and third light sources, the chromaticities of the second and third light sources interposing the blackbody locus therebetween, and wherein the chromaticities of the second and third light sources are selected such that, on straight lines passing through reference chromaticities of the second and third light sources and a chromaticity of an arbitrary color temperature on the blackbody locus, a ratio of a distance between the chromaticity of the second light source and the chromaticity on the blackbody locus to a distance between the chromaticity of the third light source and the chromaticity on the blackbody locus becomes equal to a ratio of a distance between the reference chromaticity of the second light source and the chromaticity on the blackbody locus to a distance between the reference chromaticity of third light source and the chromaticity on the blackbody locus.

Preferably, the first light source may be configured to emit white light, the second light source may be configured to emit red light, and the third light source may be configured to emit green light.

Preferably, the second light source may include a solid-state light emitting element for emitting white light and a red cover member covering the solid-state light emitting element and containing a red fluorescent material for converting the white light to red light, and wherein the third light source may include a solid-state light emitting element for emitting white light and a green cover member covering the solid-state light emitting element and containing a green fluorescent material for converting the white light to green light.

Preferably, the first light source may be configured to emit blue light, the second light source may be configured to emit red light, and the third light source may be configured to emit green light.

Preferably, the second light source may include a solid-state light emitting element for emitting blue light and a red cover member covering the solid-state light emitting element and containing a red fluorescent material for converting the blue light to red light, and wherein the third light source may include a solid-state light emitting element for emitting blue light and a green cover member covering the solid-state light emitting element and containing a green fluorescent material for converting the blue light to green light.

Preferably, the first light source may be a solid-state light emitting element for emitting blue light, the second light source being a solid-state light emitting element for emitting red light, and the third light source being a solid-state light emitting element for emitting green light.

In accordance with another aspect of the present invention, there is provided an illumination apparatus comprising the variable color light emitting device disclosed in said one aspect of the present invention.

In accordance with the present invention, the chromaticities of the second and third light sources are selected such that, on straight lines passing through reference chromaticities of the second and third light sources and a chromaticity of an arbitrary color temperature on the blackbody locus, a ratio of a distance between the chromaticity of the second light source and the chromaticity on the blackbody locus to a distance between the chromaticity of the third light source and the chromaticity on the blackbody locus becomes equal to a ratio of a distance between the reference chromaticity of the second light source and the chromaticity on the blackbody locus to a distance between the reference chromaticity of the third light source and the chromaticity on the blackbody locus. Therefore, even if deviations exist in the chromaticities of the second and third light sources, the chromaticity of the mixed color light of the first, second and third light sources can be changed in conformity with the reference chromaticities. Accordingly, it is possible to reduce the chromaticity deviation of the mixed color light regardless of feedback control. It is also possible to manufacture the variable color light emitting device in a cost-effective manner.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
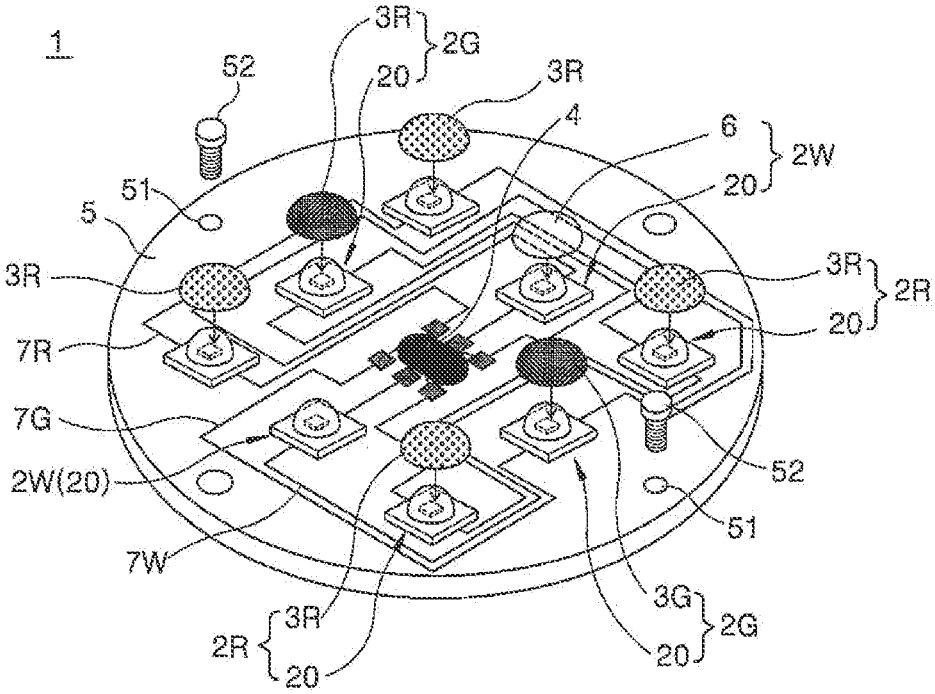
FIG. 1 is a perspective view showing a variable color light emitting device light emitting device according to one embodiment of the present embodiment.

A variable color light emitting device in accordance with one embodiment of the present invention will now be described with reference to FIGS. 1 through 3. The variable color light emitting device 1 of the present includes three kinds of light sources 2 (2W, 2R and 2G) differing in emission color. Light emitting diode (LED) units 20 for emitting white light are used as the light sources 2. As shown in FIG. 1, the light sources 2 include white light sources 2W, red light sources 2R for emitting red light and green light sources 2G for emitting green light, each of which has an LED unit 20 emitting white light. Each of the red light sources 2R includes a red cover member 3R containing a red fluorescent material for converting the light emitted from the LED unit 20 to red light. Each of the green light sources 2G includes a green cover member 3G containing a green fluorescent material for converting the light emitted from the LED unit 20 to green light. The white light sources 2W may include an adjusting cover member 6 for appropriately adjusting the chromaticity range of white light depending on the chromaticity of the light emitted from the LED unit 20. The variable color light emitting device 1 further includes a driver 4 for turning on the white light sources 2W, the red light sources 2R and the green light sources 2G, respectively.

Figure 7:
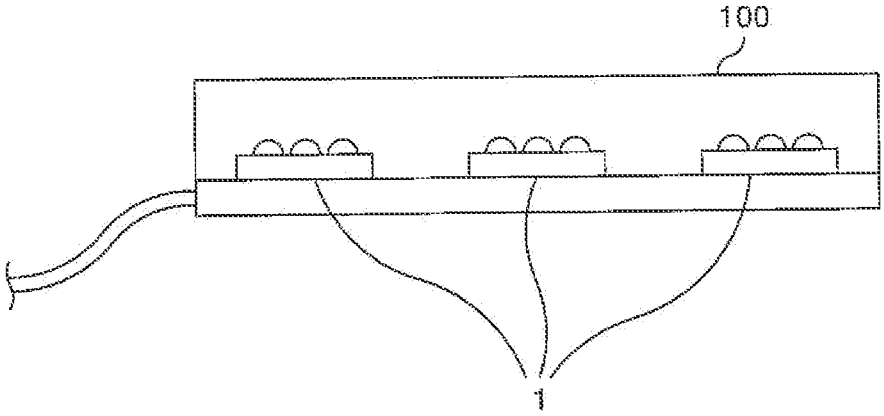
FIG. 7 is a side section view of an illumination apparatus provided with the light emitting device.

In the present embodiment, the variable color light emitting device 1 includes two white light sources 2W, four red light sources 2R and two green light sources 2G. While only one of the white light sources 2W is provided with the adjusting cover member 6 in the illustrated configuration, the present invention is not limited thereto. All the white light sources 2W may be provided with the adjusting cover member 6 or none of the white light sources 2W may be provided with the adjusting cover member 6. The driver 4 is provided within an independent power supply block which is electrically connected to a circuit board 5 by wiring lines. The wiring lines are concentrated on the central region of the circuit board 5. In the illustrated example, the concentration portion is called a driver 4 for the sake of convenience. The LED units 20 of the white light sources 2W, the red light sources 2R and the green light sources 2G are mounted in the specified positions on the circuit board 5 so as to surround the driver 4. The driver 4 includes at least three kinds of output terminals corresponding to the respective light sources 2W, 2R and 2G differing in emission color. On the circuit board 5, there are formed wiring circuits 7W, 7R and 7G so that the light sources 2 having the same emission color can be electrically connected to the same kinds of output terminals of the driver 4. The variable color light emitting device 1 configured as above is preferably arranged within an illumination apparatus 100 (see FIG. 7) capable of controlling the color temperature of irradiated light.

The circuit board 5 is a board for general-purpose light emitting modules and is made of, e.g., metal oxide (including ceramics) with an electric insulation property such as aluminum oxide ($Al_2O_3$) or aluminum nitride (AlN), metal nitride, resin or glass. A plurality of through-holes 51 is formed in the peripheral edge portion of the circuit board 5. The variable color light emitting device 1 is fixed to a body of the illumination apparatus 100 by fixing screws 52 inserted through the through-holes 51.

Figure 2A:
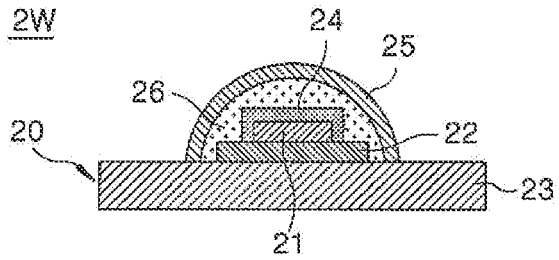
FIG. 2A is a side section view of a white light source employed in the light emitting device.

As shown in FIG. 2A, the LED unit 20 includes an LED chip 21, a sub-mount member 22 for holding the LED chip 21 and a mounting substrate 23 to which the LED chip 21 is mounted through the sub-mount member 22. The LED chip 21 is covered with a cover resin 24 containing a fluorescent material. A dome-shaped light-transmitting cover 25 is arranged on the mounting substrate 23 so as to cover the LED chip 21 and the sub-mount member 22. A seal material 26 is filled between the light-transmitting cover 25 and the mounting substrate 23.

Preferably, a GaN-based blue LED chip for emitting blue light is used as the LED chip 21. An anode electrode and a cathode electrode (not shown) are formed on one surface of the LED chip 21 having a rectangular shape. The structure of the LED chip 21 is not particularly limited. For example, the anode electrode and the cathode electrode may be formed on different surfaces of the LED chip 21. As the cover resin 24, it is possible to use a light-transmitting resin, e.g., a silicon resin, containing a YAG-based yellow fluorescent material. The LED chip 21 covered with the cover resin 24 can emit white light by mixing the blue light emitted from the LED chip 21 and the yellow light obtained by wavelength-converting the blue light with a yellow fluorescent material. Instead of using the cover resin 24 containing a yellow fluorescent material, it may be possible to add a yellow fluorescent material to the seal material 26. The light-transmitting cover 25 and the seal material 26 are made of a light-transmitting resin such as a silicon resin. It is preferred that the light-transmitting cover 25 and the seal material 26 be made of the same material or a material having the same refractive index.

The sub-mount member 22 is a rectangular plate-like member formed into a size larger than the size of the LED chip 21 and is made of an insulating material having a high heat conductivity. The sub-mount member 22 includes electrode patterns (not shown) electrically connected to the anode electrode and the cathode electrode of the LED chip 21 through bonding wires (not shown). The mounting surface of the sub-mount member 22 may be configured to have light reflectivity or diffuse reflectivity. The LED chip 21 and the sub-mount member 22 are bonded to each other by, e.g., solder or silver paste.

The mounting substrate 23 is a rectangular plate-like member formed into a size larger than the size of the sub-mount member 22. A printed wiring substrate having conductive patterns (not shown) connected to the electrode patterns of the sub-mount member 22 is used as the mounting substrate 23. All the portions of the conductive patterns, excluding the portions connected to the electrode patterns of the sub-mount member 22 and the electrode portions (not shown) connected to external components, are covered with an insulating protective layer (not shown). The mounting substrate 23 includes a heat transfer layer (not shown) making contact with the peripheral edge of the sub-mount member 22 and extending outward from the contact portion. The heat generated in the LED chip 21 is dissipated through the sub-mount member 22 and the heat transfer layer. After the LED chip 21 and the sub-mount member 22 are mounted on the mounting substrate 23, the light-transmitting cover 25 is fixed to the mounting substrate 23 by an adhesive agent (not shown) such as a silicon resin or an epoxy resin so that the light-transmitting cover 25 can cover the LED chip 21 and the sub-mount member 22.

The LED unit 20 stated above is commercially available as a modularized ready-made article. The LED chromaticity regulation (ANSI standard) stipulated in U.S.A. become substantially the world standard. The LED unit complying with this regulation is configured such that the chromaticity deviation falls within a specified range from the blackbody locus. Accordingly, from the viewpoint of manufacturing efficiency of the variable color light emitting device 1, it is more preferable to purchase the LED unit complying with the aforementioned regulation from a market than to directly manufacture and tune the LED chip 21, the cover resin 24 and so forth.

In the LED unit 20, the light emitted from the LED chip 21 is transmitted through the cover resin 24 and the seal material 26 and is projected from the light-transmitting cover 25 as white light. If the chromaticity of the white light exists within a specified chromaticity range along the blackbody locus, the LED unit 20 is directly used as the white light source 2W. The chromaticity deviations of a general-purpose white LED unit (package) depend largely on the amount of a yellow fluorescent material. The chromaticity deviations are distributed on a straight line passing through a yellow color (575 nm) and a blue color (475 nm). Since the straight line extends substantially along the blackbody locus, the chromaticity deviations along a duv direction become small in the white LED unit. If the chromaticity of the white light emitted from the LED unit 20 does not exist within the specified chromaticity range, the adjusting cover member 6 (see FIG. 1) for adjusting the chromaticity range is provided as set forth above. This enables the LED unit 20 to be used as the white light source 2W.

The adjusting cover member 6 is made of a light-transmitting resin such as a silicon resin containing a red fluorescent material (e.g., a CASN fluorescent material such as $CaAlSiN_3$:Eu) or a green fluorescent material (e.g., CSO fluorescent material such as $CaSc_2O_4$:Ce) at a specified concentration. The adjusting cover member 6 is produced by forming a resin material containing the fluorescent material into a dome shape so that a small gap can exist between the adjusting cover member 6 and the light-transmitting cover 25.

Figure 2B:
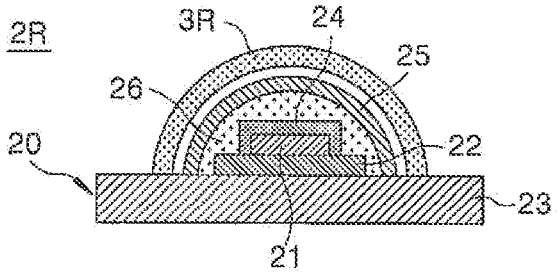
FIG. 2B is a side section view of a red light source employed in the light emitting device.
Figure 2C:
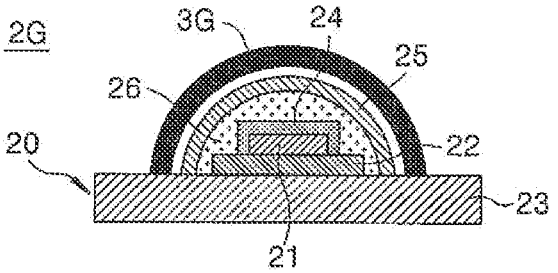
FIG. 2C is a side section view of a green light source employed in the light emitting device.

As shown in FIG. 2B, each of the red light sources 2R is produced by adding a red cover member 3R to the LED unit 20 set forth above. The red cover member 3R is produced by forming the same light-transmitting resin as the adjusting cover member 6, which contains a red fluorescent material (e.g., 30 wt % of CASN), into the same shape as the adjusting cover member 6. As shown in FIG. 2C, just like the red light sources 2R, each of the green light sources 2G is produced by adding a green cover member 3G, which is made of a light-transmitting resin containing a green fluorescent material (e.g., 30 wt % of CSO), to the LED unit 20.

Figure 3:
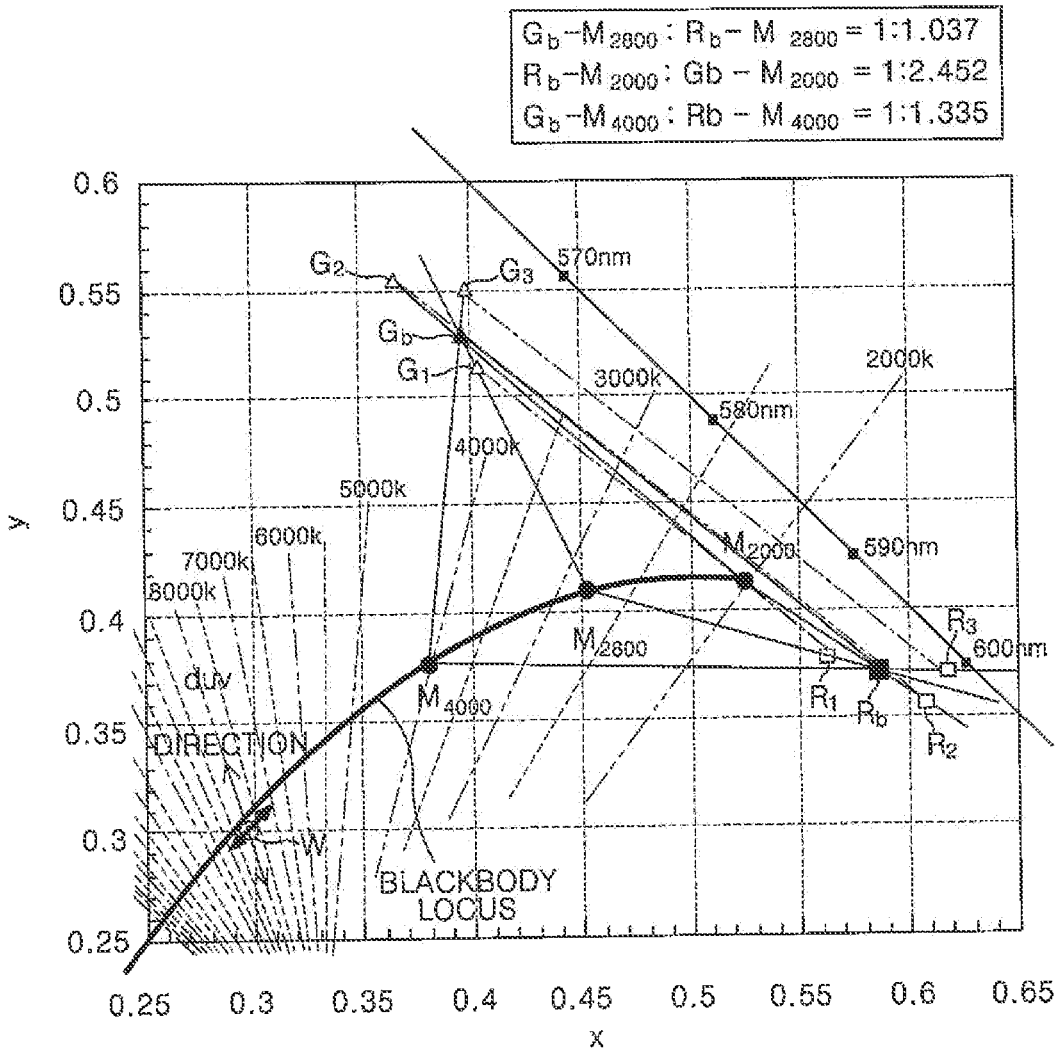
FIG. 3 is a chromaticity diagram illustrating the chromaticities of the light projected from the respective light sources of the light emitting device and the chromaticity of the mixed color light thereof.

Referring now to FIG. 3, description will be made on how to select the white light sources 2W, the red light sources 2R and the green light sources 2G and how to install them within the variable color light emitting device 1. Among the three kinds of light sources 2, the white light sources 2W have a chromaticity closer to the blackbody locus of chromaticity coordinates as compared with the red light sources 2R and the green light sources 2G. If the chromaticity of a general-purpose white LED unit falls within a specified range, the white LED unit is directly used as the white light source 2W. As mentioned earlier, the chromaticity deviations of the general-purpose white LED units along a duv direction are small and the chromaticities are distributed along the blackbody locus. Therefore, if the general-purpose white LED unit is used as the white light source 2W, the chromaticity of mixed color light has a small deviation along a duv direction.

Next, reference chromaticities $R_b$ and $G_b$ serving as references of the chromaticities of the red light source 2R and the green light source 2G are set in order to select the red light source 2R and the green light source 2G. In the present embodiment, it is assumed that the chromaticity coordinates of the reference chromaticity $R_b$ of the red light source 2R are (0.5855 and 0.3698) and the chromaticity coordinates of the reference chromaticity $G_b$ of the green light source 2G are (0.3955 and 0.5303). The red light source 2R and the green light source 2G are selected so that, on the straight lines $R_b$–M and $G_b$–M passing through the reference chromaticities $R_b$ and $G_b$ and the chromaticity M (not shown) of an arbitrary color temperature on the blackbody locus, the ratio of the distance between the chromaticity of the light source 2R and the chromaticity M to the distance between the chromaticity of the light source 2G and the chromaticity M can become equal to the ratio of the distance between the reference chromaticity $R_b$ and the chromaticity M to the distance between the reference chromaticity $G_b$ and the chromaticity M. Particularly, one of the red light source 2R and the green light source 2G is selected and then the other is selected.

More specifically, an arbitrary one of a plurality of green light sources 2G prepared for the manufacture of the variable color light emitting device 1 is selected first. Then the chromaticity of the green light source 2G thus selected is measured. In this regard, it is assumed that the x value of the chromaticity of the selected green light source 2G is larger than the x value of the reference chromaticity $G_b$ but the y value of the chromaticity of the selected green light source 2G is smaller than the y value of the reference chromaticity $G_b$ in the chromaticity coordinates. The chromaticity of the selected green light source 2G is designated by G1 in FIG. 3. When the chromaticity G1 exists on the straight line $G_b$–$M_{2800}$ passing through the reference chromaticity $G_b$ and the chromaticity $M_{2800}$ of the color temperature 2800K on the blackbody locus, the distance ($G_b$–$M_{2800}$) between the reference chromaticity $G_b$ and the chromaticity $M_{2800}$ on the blackbody locus is calculated. In addition, the distance ($R_b$–$M_{2800}$) between the reference chromaticity $R_b$ of the red light source 2R and the chromaticity $M_{2800}$ of the color temperature 2800K on the blackbody locus is calculated. Then the ratio of $G_b$–$M_{2800}$ to $R_b$–$M_{2800}$ is calculated. In this regard, it is assumed that the ratio of $G_b$–$M_{2800}$ to $R_b$–$M_{2800}$ is 1:1.037. At this time, the red light source 2R is selected so that the ratio ($G_1$–$M_{2800}$:$R_1$–$M_{2800}$) of the distance ($G_1$–$M_{2800}$) between the chromaticity G1 of the selected green light source 2G and the chromaticity $M_{2800}$ on the blackbody locus to the distance ($R_1$–$M_{2800}$) between the chromaticity $R_1$ ($R_1$ in FIG. 3) of the selected red light source 2R and the chromaticity $M_{2800}$ can become equal to 1:1.037.

This holds true in case where the red light source 2R is selected first and then the green light source 2G corresponding thereto is selected. First, an arbitrary one of a plurality of red light sources 2R prepared for the manufacture of the variable color light emitting device 1 is selected. Then the chromaticity of the red light source 2R thus selected is measured. In this regard, it is assumed that the x value of the chromaticity of the selected red light source 2R is larger than the x value of the reference chromaticity $R_b$ but the y value of the chromaticity of the selected red light source 2R is smaller than the y value of the reference chromaticity $R_b$ in the chromaticity coordinates. The chromaticity of the selected red light source 2R is designated by $R_2$ in FIG. 3. When the chromaticity $R_2$ exists on the straight line $R_b$–$M_{2000}$ passing through the reference chromaticity $R_b$ and the chromaticity $M_{2000}$ of the color temperature 2000K on the blackbody locus, the distance ($R_b$–$M_{2000}$) between the reference chromaticity $R_b$ and the chromaticity $M_{2000}$ on the blackbody locus is calculated. In addition, the distance ($G_b$–$M_{2000}$) between the reference chromaticity $G_b$ of the green light source 2G and the chromaticity $M_{2000}$ of the color temperature 2000K on the blackbody locus is calculated. Then the ratio of $R_b$–$M_{2000}$ to $G_b$–$M_{2000}$ is calculated. In this regard, it is assumed that the ratio of $R_b$–$M_{2000}$ to $G_b$–$M_{2000}$ is 1:2.452. At this time, the green light source 2G is selected so that the ratio ($R_2$–$M_{2000}$ $G_2$–$M_{2000}$) of the distance ($R_2$–$M_{2000}$) between the chromaticity $R_2$ of the selected red light source 2R and the chromaticity $M_{2000}$ on the blackbody locus to the distance ($G_2$–$M_{2000}$) between the chromaticity $G_2$ ($G_2$ in FIG. 3) of the selected green light source 2G and the chromaticity $M_{2000}$ can become equal to 1:2.452.

In the example described above, there is illustrated a case where all the green light source 2G (the chromaticity $G_1$) and the red light source 2R (the chromaticity $R_2$) selected arbitrarily exist on the straight line $G_b$–$M_{2800}$ or the straight line $R_b$–$M_{2000}$. However, the chromaticity on the blackbody locus is an intersection point between the straight line, which passes through the chromaticity of the arbitrarily selected light source and the reference chromaticity, and the blackbody locus. The chromaticity on the blackbody locus is not a predetermined value but an arbitrary value that depends on the chromaticity of the previously selected light source. For example, it is assumed that the chromaticity of an arbitrarily selected one of the prepared green light sources 2G is the chromaticity designated by $G_3$ in FIG. 3. At this time, the intersection point between the straight line passing through the chromaticity $G_3$ and the reference chromaticity $G_b$ and the blackbody locus becomes the chromaticity on the blackbody locus used in selecting the red light source 2R. In the illustrated example, the chromaticity on the blackbody locus coincides with the chromaticity ($M_{4000}$) of the color temperature 4000K. Then, as described above, the distance ($G_b$–$M_{4000}$) between the reference chromaticity $G_b$ and the chromaticity $M_{4000}$ on the blackbody locus is calculated. In addition, the distance ($R_b$–$M_{4000}$) between the reference chromaticity $R_b$ of the red light source 2R and the chromaticity $M_{4000}$ on the blackbody locus is calculated. Then the ratio of $G_b$–$M_{4000}$ to $R_b$–$M_{4000}$ is calculated. In this regard, it is assumed that the ratio of $G_b$–$M_{4000}$ to $R_b$–$M_{4000}$ is 1:1.335. At this time, the red light source 2R is selected so that the ratio ($G_2$–$M_{4000}$: $R_3$–$M_{4000}$) of the distance ($G_3$–$M_{4000}$) between the chromaticity $G_3$ of the selected green light source 2G and the chromaticity $M_{4000}$ on the blackbody locus to the distance ($R_3$–$M_{4000}$) between the chromaticity $R_3$ ($R_3$ in FIG. 3) of the selected red light source 2R and the chromaticity $M_{4000}$ can become equal to 1:1.335. For the sake of description, the distances between the chromaticities $G_1$ and $R_1$ and the reference chromaticities $R_b$ and $G_b$ are exaggeratedly shown in FIG. 3. In reality, the green light source 2G and the red light source 2R are prepared so that the chromaticities $G_1$ and $R_1$ come closer to the reference chromaticities $R_b$ and $G_b$. Accordingly, it is hard to imagine, e.g., a case where the straight line passing through the chromaticity $G_1$ and the reference chromaticity $G_b$ does not have an intersection point with the blackbody locus.

If the green light sources 2G (having the chromaticities $G_1$, $G_2$ and $G_3$) and the red light sources 2R (having the chromaticities $R_1$, $R_2$ and $R_3$) are selected in this manner, all the straight lines ($G_1$–$R_1$, $G_2$–$R_2$ and $G_3$–$R_3$) interconnecting the corresponding chromaticities become parallel to the straight line $G_b$–$R_b$ interconnecting the respective reference chromaticities $R_b$ and $G_b$. The chromaticity of the mixed color light of the green light emitted from the green light source 2G and the red light emitted from the red light source 2R is changed depending on the output ratio of the green light and the red light along the straight line interconnecting the chromaticity of the green light source 2G and the chromaticity of the red light source 2R. The chromaticity of the light projected from the variable color light emitting device 1 can be obtained by mixing the mixed color light of the green light source 2G and the red light source 2R with the light emitted from the white light source 2W. In other words, the chromaticity of the light (mixed color light) projected from the variable color light emitting device 1 is decided by shifting the chromaticity of the white light source 2W toward the straight line interconnecting the chromaticity of the green light source 2G and the chromaticity of the red light source 2R. The variable color light emitting device 1 changes the light color along the shift direction.

Since the straight lines $G_1$–$R_1$, $G_2$–$R_2$ and $G_3$–$R_3$ are parallel to the straight line $G_b$–$R_b$, the green light source 2G (having the chromaticities $G_1$, $G_2$ and $G_3$) and the red light source 2R (having the chromaticities $R_1$, $R_2$ and $R_3$) selected in the afore-mentioned manner shift the chromaticity W of the white light source 2W in the same direction as the straight line $G_b$–$R_b$ interconnecting the reference chromaticities. In other words, the light sources 2R and 2G selected in the afore-mentioned manner can change the chromaticity of the mixed color light of three kinds of light sources 2W, 2R and 2G in conformity with the reference chromaticities $G_b$ and $R_b$ even if deviations exist in the chromaticities thereof. If the reference chromaticities $G_b$ and $R_b$ are set such that the shift direction conforms to the blackbody locus, the green light source 2G (having the chromaticities $G_1$, $G_2$ and $G_3$) and the red light source 2R (having the chromaticities $R_1$, $R_2$ and $R_3$) can shift the chromaticity W of the white light source 2W along the blackbody locus. As a result, the chromaticity of the mixed color light of the respective light sources 2W, 2R and 2G can be changed along the blackbody locus. Thus the mixed color light becomes natural white light whose chromaticity deviation is reduced at any color temperature.

If the red light source 2R and the green light source 2G are selected in the afore-mentioned manner, it becomes possible to use the red light source 2R and the green light source 2G in the variable color light emitting device 1 even when the red light source 2R and the green light source 2G have chromaticity deviations caused by the production tolerance thereof. Accordingly, the light sources (light emitting elements) can be effectively utilized without waste, which makes it possible to increase the throughput. In addition, there is no need to perform the feedback control by which a suitable mixing ratio is calculated and outputted using the measurement results of illuminance and chromaticity of the respective light sources. This eliminates the need to use a plurality of sensors and an expensive control unit having high operational performance. It is therefore possible to manufacture the variable color light emitting device 1 in a cost-effective manner.

Figure 4A:
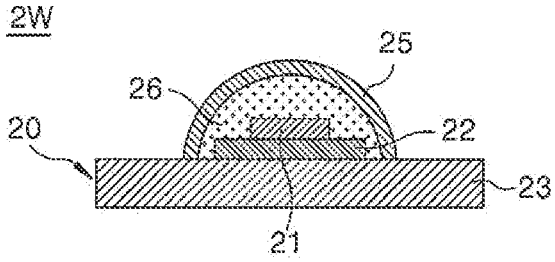
FIG. 4A is a side section view of a blue light source employed in a variable color light emitting device according to one modified example.

Next, a variable color light emitting device in accordance with one modified example of the foregoing embodiment will be described with reference to FIGS. 4 and 5. In the variable color light emitting device 1 in accordance with this modified example, a blue light source 2B shown in FIG. 4A is used in place of the white light source 2W of the foregoing embodiment. In the blue light source 2B, the LED chip 21 for emitting blue light is not covered with the cover resin 24 containing a fluorescent material. Other configurations of the blue light source 2B remain the same as the configurations of the white light source 2W. It is preferred that, as shown in FIG. 5, the chromaticity of the blue light source 2B exists near a line extending from the blackbody locus toward the high color temperature side.

Figure 4B:
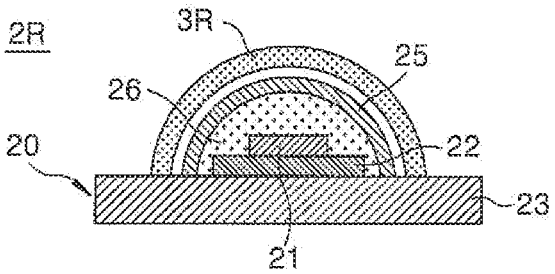
FIG. 4B is a side section view of a red light source employed in the light emitting device.
Figure 4C:
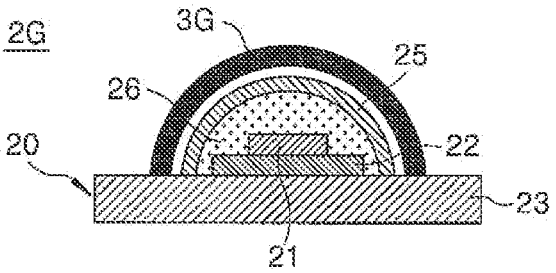
FIG. 4C is a side section view of a green light source employed in the light emitting device.
Figure 5:
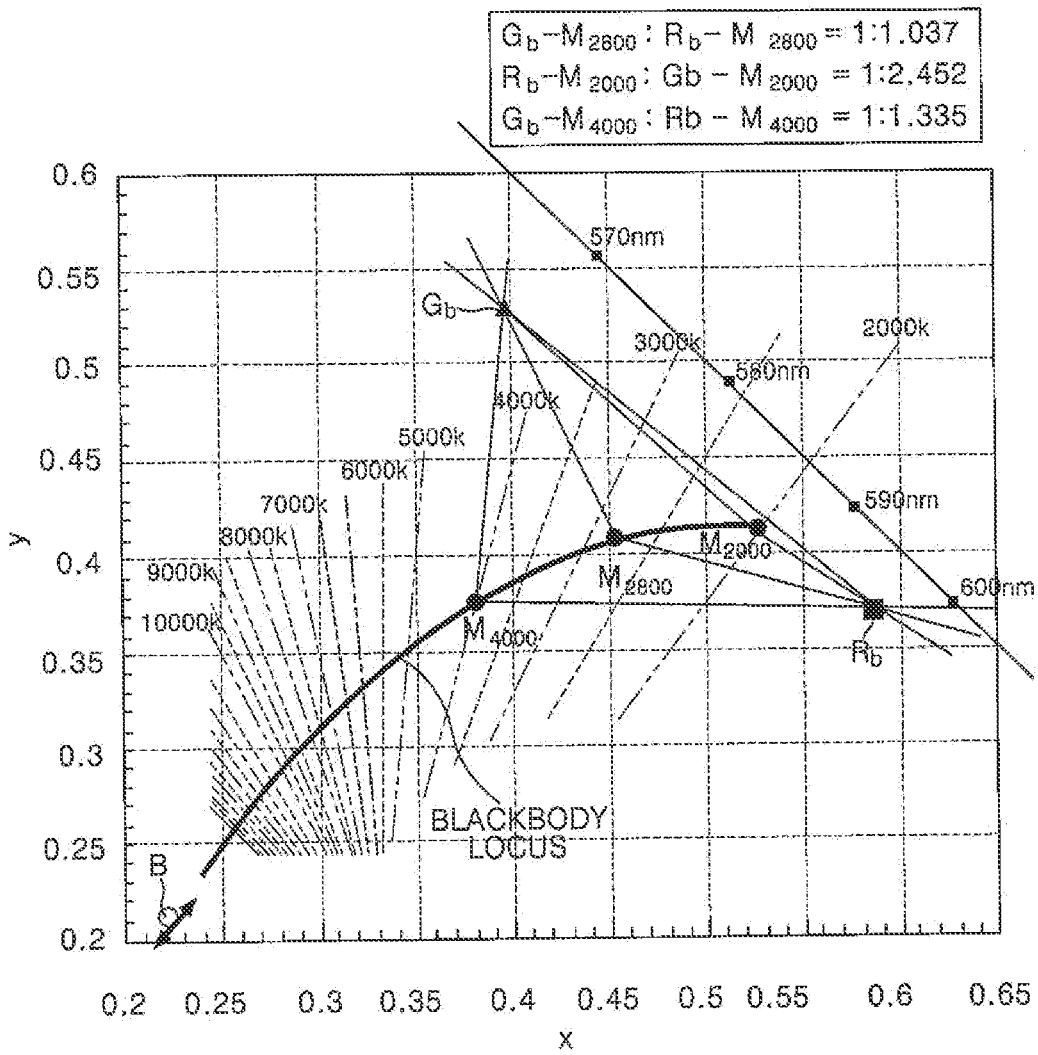
FIG. 5 is a chromaticity diagram illustrating the chromaticities of the light projected from the respective light sources of the light emitting device according to one modified example and the chromaticity of the mixed color light thereof.

In the red light source 2R, as shown in FIG. 4B, the LED chip 21 is not covered with the cover resin 24 containing a fluorescent material. The red light source 2R may include a red cover member 3R' for converting the blue light emitted from the LED chip 21 to red light. Similarly, the green light source 2G may include a green cover member 3G' for converting the blue light emitted from the LED chip 21 to green light. The red light source 2R and the green light source 2G may be the same as those of the foregoing embodiment.

In this modified example, the red light source 2R and the green light source 2G are selected in the afore-mentioned manner and are installed within the variable color light emitting device 1. With this configuration, the chromaticity of the blue light source 2B is shifted toward the straight line interconnecting the reference chromaticities $G_b$ and $R_b$. It is therefore possible to reduce the chromaticity deviation of mixed color light as is the case in the foregoing embodiment. The chromaticity of the blue light source 2B is smaller in the x value and y value than the chromaticity of the white light source 2W in chromaticity coordinates. Therefore, the triangle interconnecting the chromaticities of the blue light source 2B, the red light source 2R and the green light source 2G grows larger than the color mixing range (e.g., 2000K to 5000K). Thus the chromaticity of the mixed color light tends to fall within the color mixing range even if the outputs of the respective light sources 2B, 2R and 2G are increased. This makes it possible to increase the output of the mixed color light. Since there is no need to convert the blue light to the white light, it is possible to reduce the loss of light energy during wavelength conversion and to enhance the light utilization efficiency. Inasmuch as it is not necessary to use the fluorescent material for converting the blue light to the white light and the cover resin 24 containing the fluorescent material, it is possible to reduce the material cost and to manufacture the variable color light emitting device 1 in a cost-effective manner.

Figure 6A:
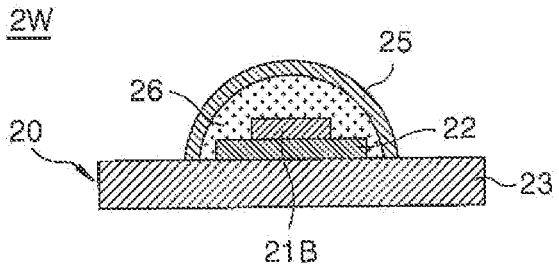
FIG. 6A is a side section view of a blue light source employed in a variable color light emitting device according to another modified example.
Figure 6B:
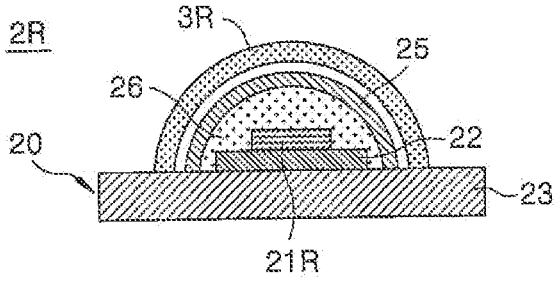
FIG. 6B is a side section view of a red light source employed in the light emitting device.
Figure 6C:
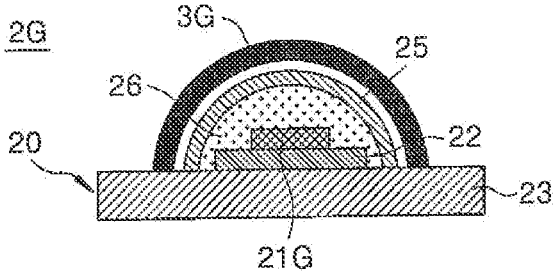
FIG. 6C is a side section view of a green light source employed in the light emitting device.

Next, a variable color light emitting device in accordance with another modified example of the foregoing embodiment will be described with reference to FIGS. 6A through 6C. In the variable color light emitting device 1 in accordance with this modified example, a blue LED chip 21B for emitting blue light is used as the blue light source 2B. A red LED chip 21R for emitting red light is used as the red light source 2R. A green LED chip 21G for emitting green light is used as the green light source 2G. Other configurations of this modified example remain the same as those of the modified example described above.

With this configuration, it is not necessary to use the red cover member 3R and the green cover member 3G as well as the cover resin 24 containing the fluorescent material. It is therefore possible to reduce the material cost and to manufacture the variable color light emitting device 1 in a cost-effective manner.

The present invention is not limited to the embodiment and the modified examples described above but may be modified in many different forms. In the above-described modified example, the blue light source 2B is used in place of the white light source 2W of the foregoing embodiment. Alternatively, both the white light source 2W and the blue light source 2B may be employed in the variable color light emitting device 1. In this case, the light sources 2W and 2B may be selected such that the straight line interconnecting the chromaticity of the white light source 2W and the chromaticity of the blue light source 2B conforms to the blackbody locus. The red light source 2R and the green light source 2G may be selected in the same manner as in the foregoing embodiment. In this case, even if four kinds of the light sources 2W, 2B, 2R and 2G are used, the chromaticity of the mixed color light thereof is changed along the blackbody locus. It is therefore possible to reduce the chromaticity deviation.

While the invention has been shown and described with respect to the preferred embodiment, it will be understood by those skilled in the art that various changes and modifications may be made without departing from the spirit and scope of the invention as defined in the following claims.

What is claimed is:

1. A variable color light emitting device, comprising:

first, second and third light sources differing in chromaticity of emission light; and a driver for changing light outputs of the first, second and third light sources, wherein the first light source has a chromaticity closer to a blackbody locus in a chromaticity coordinates than chromaticities of the second and third light sources, the chromaticities of the second and third light sources interposing the blackbody locus therebetween, and wherein the chromaticities of the second and third light sources are selected such that, on straight lines passing through reference chromaticities of the second and third light sources and a chromaticity of an arbitrary color temperature on the blackbody locus, a ratio of a distance between the chromaticity of the second light source and the chromaticity on the blackbody locus to a distance between the chromaticity of the third light source and the chromaticity on the blackbody locus becomes equal to a ratio of a distance between the reference chromaticity of the second light source and the chromaticity on the blackbody locus to a distance between the reference chromaticity of third light source and the chromaticity on the blackbody locus.

2. The device of claim 1, wherein the first light source is configured to emit white light, the second light source is configured to emit red light, and the third light source is configured to emit green light.

3. The device of claim 2, wherein the second light source includes a solid-state light emitting element for emitting white light and a red cover member covering the solid-state light emitting element and containing a red fluorescent material for converting the white light to red light, and wherein the third light source includes a solid-state light emitting element for emitting white light and a green cover member covering the solid-state light emitting element and containing a green fluorescent material for converting the white light to green light.

4. The device of claim 1, wherein the first light source is configured to emit blue light, the second light source is configured to emit red light, and the third light source is configured to emit green light.

5. The device of claim 4, wherein the second light source includes a solid-state light emitting element for emitting blue light and a red cover member covering the solid-state light emitting element and containing a red fluorescent material for converting the blue light to red light, and wherein the third light source includes a solid-state light emitting element for emitting blue light and a green cover member covering the solid-state light emitting element and containing a green fluorescent material for converting the blue light to green light.

6. The device of claim 4, wherein the first light source is a solid-state light emitting element for emitting blue light, the second light source being a solid-state light emitting element for emitting red light, and the third light source being a solid-state light emitting element for emitting green light.

7. An illumination apparatus comprising the variable color light emitting device of claim 1.

* * * * *